United States Patent [19]

Goodwin

[11] Patent Number: 4,595,168

[45] Date of Patent: Jun. 17, 1986

[54] PLASTIC LINED PAPER FORM FOR CASTING CONCRETE COLUMNS

[75] Inventor: Paul Goodwin, Mississauga, Canada

[73] Assignee: Perma Tubes Ltd., Mississauga, Canada

[21] Appl. No.: 583,165

[22] Filed: Feb. 24, 1984

[30] Foreign Application Priority Data

Feb. 20, 1984 [CA] Canada ..... 447831

[51] Int. Cl.[4] ..... B28B 7/34; B28B 7/36

[52] U.S. Cl. ..... 249/48; 249/51; 249/61; 249/112; 249/134; 249/DIG. 2

[58] Field of Search ..... 249/48, 51, 61, 112, 249/115, 134, DIG. 2; 229/3.1, 93; 138/128, 129, 137, 154, 145, 156, 150

[56] References Cited

U.S. PATENT DOCUMENTS

| | | | |
|---|---|---|---|
| 1,224,584 | 5/1917 | Vogan | 249/15 |
| 2,677,165 | 5/1954 | Copenhaver et al. | 249/48 |
| 2,836,874 | 6/1958 | Clarkson | 249/48 |
| 2,895,511 | 7/1959 | Seltman | 138/150 |
| 2,914,833 | 12/1959 | Hart, Jr. et al. | 249/48 |
| 3,072,312 | 1/1963 | Stump | 229/3.1 |
| 3,245,648 | 4/1966 | Johansson et al. | 249/112 |
| 3,320,344 | 5/1967 | Slipp | 249/112 |
| 3,427,178 | 2/1969 | Zakim et al. | 249/115 |
| 3,435,853 | 4/1969 | Weeden et al. | 138/147 |
| 3,454,257 | 7/1969 | Dupuis | 249/173 |
| 3,643,911 | 2/1972 | Reid | 249/112 |
| 3,974,996 | 8/1976 | Violet | 249/112 |
| 4,017,234 | 4/1977 | Andrews et al. | 425/145 |
| 4,081,169 | 3/1978 | Lauter | 249/115 |

OTHER PUBLICATIONS

"Polystyrene Lined Shuttering for Concrete", *British Plastics* Nov. 1958, p. 467.

*Primary Examiner*—Jay H. Woo
*Assistant Examiner*—James C. Housel
*Attorney, Agent, or Firm*—Weingarten, Schurgin, Gagnebin & Hayes

[57] ABSTRACT

The present invention relates to a disposable concrete forming apparatus. The apparatus includes an elongate, tubular and rigid form having at least one inner wall surface defining an enclosure in which concrete can be poured and allowed to harden. The apparatus further includes a flexible liner of predetermined thickness which lines the inner surface to preclude formation of form lines on the hardened concrete that correspond to markings on the inner wall surface of the rigid form. The flexible liner has at least one outside wall surface for each inner wall surface and is movable between a compressed position permitting insertion of the liner into the enclosure and a normal expanded position with the outside wall surface pressing against the inner wall surface of the rigid form. As a result, no gap is present between the inner wall surface and the outer wall surface.

7 Claims, 9 Drawing Figures

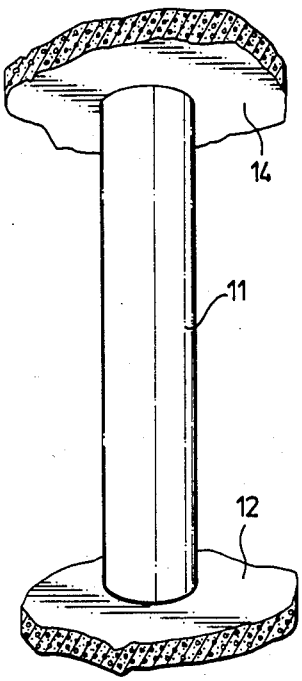
FIG. 1.
FIG. 2.
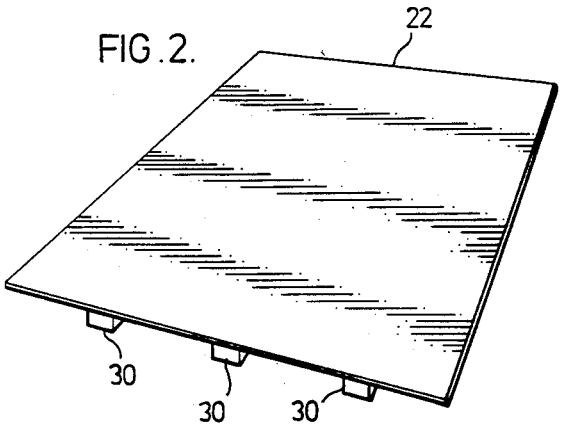
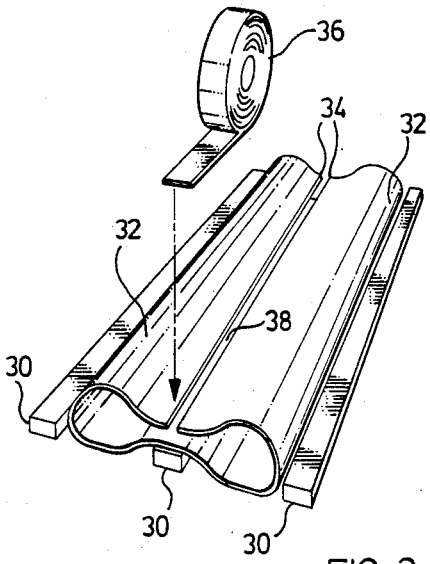
FIG. 3.

PLASTIC LINED PAPER FORM FOR CASTING CONCRETE COLUMNS

The present invention relates to a concrete forming apparatus and in particular relates to a concrete forming apparatus suitable for use in forming concrete support columns.

In the past, elongate paper fiber tubes have been used to form concrete columns. The tubes are made by spirally winding several layers of strong fiber paper. The spirally wound paper is laminated along its seams with a special adhesive. The outside surface of the tube can be coated with hot wax for protection against adverse weather conditions.

Concrete is poured into the tube and allowed to harden so as to form a column. After hardening, the tube is stripped away from the concrete column and scrapped. One characteristic of using the paper fiber tubes is that the concrete column displays a rough finish and a spiral form line that winds up the column. The spiral form line winding up the column is the result of an impression left by the spiral seam of the tube. The spiral form lines are quite common and are not always considered asthetically pleasing. The column can be sandblasted, to diminish the appearance of the spiral line, however, the spiral line will still be visible. Sandblasting roughens the surface of the concrete which does not provide the most efficient surface for coating should the column require a decorative or protective coating.

Another problem with using the fiber tube is that as the concrete hardens it re-adsorbs moisture through the spiral seam of the tube leaving a stain on the hardened concrete. The stain is not asthetically pleasing and when the column is to be painted or coated, the stain makes it difficult to obtain a uniform appearance for the coating.

It is therefore an object of the present invention to provide a disposable concrete forming apparatus that precludes formation of form lines on the hardened concrete that correspond to markings on the rigid forming tube.

It is another object of the present invention to provide a disposable concrete forming apparatus which prevents the concrete from re-adsorbing moisture through seams in the rigid forming means.

It is a further object of the present invention to provide a disposable concrete forming apparatus which produces a predetermined finish or pattern on the formed concrete.

In accordance with one aspect of the present invention there is provided a disposable concrete forming apparatus, comprising a rigid forming means having at least one inner wall surface defining an enclosure into which concrete can be poured and allowed to harden. The apparatus further includes a flexible liner means of predetermined thickness which lines the inner wall surface of the rigid forming means to preclude formation of form lines on the hardened concrete that correspond to markings on the inner wall surface. The flexible liner means has at least one outside wall surface for each inner wall surface. The flexible liner means is movable between a compressed position permitting insertion of the liner means into the enclosure and a normal expanding position with the outside wall surface pressing against the inner wall surface of the rigid forming means whereby no gap is present between the inner wall surface and the outer wall surface.

By providing a flexible liner means, the liner can be bent to be inserted into the enclosure defined by the rigid forming means. Further, the liner provides a surface which precludes the inner wall surface of the rigid forming means leaving an impression or producing a form line on the hardened concrete due to markings or irregularities on the inner surface.

The flexible liner may comprise an impermeable material so as to prevent concrete forming in the enclosure from re-adsorbing water from seams in the rigid forming means. The inner wall surface of the liner means may further have a predetermined finish or pattern which is impressed on the concrete surface. In the preferred construction, the finish is a high gloss finish. As a result, the concrete column or structure formed inside the enclosure has a high gloss finish of a very smooth surface similar to a marble finish. Such a surface can be readily coated with a protective coating or decorative coating.

The forming apparatus may further include means for preventing at least one end of the liner means from slipping relative to the rigid forming means. This slip preventing means may comprise tape interconnecting the open ends of the flexible liner means and the rigid forming means together. These ends are taped to wind from separating the liner means from the rigid forming means during transportation of the apparatus. At the job site, one of the ends of the rigid forming means and liner means should have the tape removed to allow for expansion of the flexible liner means relative to the rigid forming means due to changes in weather conditions; otherwise the liner means may buckle relative to the rigid forming means. The other end of the rigid forming means and liner means is to remain taped to the upper end of the concrete forming apparatus, such that the concrete will not force the liner away from the tube.

The liner means may comprise a sheet of plastic material bendable into a shape where the outside lateral edges of the sheet can be secured or interconnected adjacent each other. The lateral edges may be secured adjacent each other by means of tape or other suitable fastening means. It should be understood that a seam will exist between the lateral edges which may extend vertically up the column. This seam is not as visible as the spiral form lines and may be readily removed by a sand blasting technique.

In accordance with another aspect of the invention, there is provided a method of manufacturing a disposable concrete forming apparatus comprising:

(a) forming a rigid elongate tubular member;
(b) folding a sheet of flexible plastic material such that the outside lateral edges of the sheet are positioned adjacent each other with two folds projecting outwardly therefrom;
(c) interconnecting the lateral edges;
(d) bending the sheet along a seam provided between the lateral edges and positioning the folds adjacent each other; and
(e) inserting the sheet into the rigid elongate tubular member and allowing it to expand whereby the sheet presses against and lines the inner surface of the rigid tubular member.

By forming the liner means from a flat sheet of flexible material, the liner has a resiliently biased effect which results in the liner tending to push outwardly against the inside wall of the rigid tubular member.

The method may further include the step of taping one end of the sheet to one end of the rigid tubular member and the step of interconnecting the lateral edges may comprise taping the edges together.

For a better understanding of the nature and objects of the present invention, reference is made to the accompanying diagrammatic drawings, in which:

FIG. 1 is a perspective view showing a concrete column formed by the disposable concrete forming apparatus of the present invention;

FIGS. 2, 3 and 4 are views that respectively illustrate the first, second and third steps in forming the lining used in the disposable concrete forming apparatus of the present invention;

Figure 4:
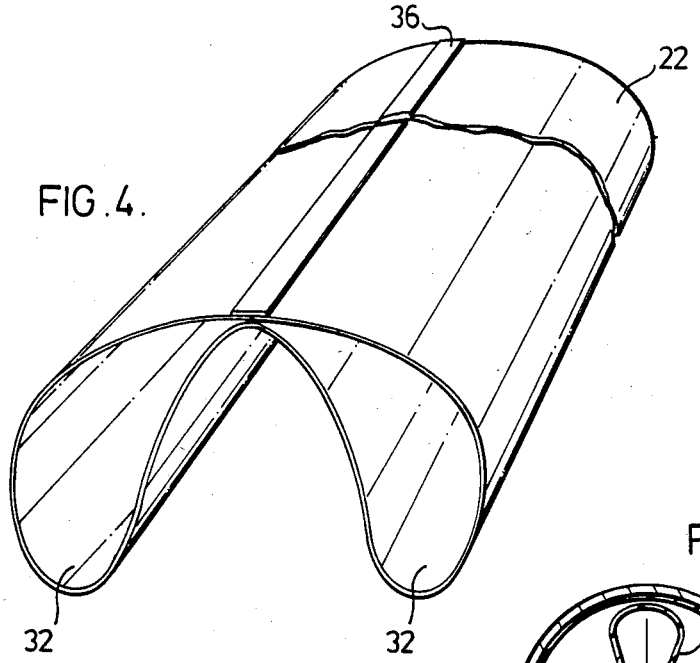

Referring to the drawings, it will be evident that the disposable concrete forming apparatus 10 of the present invention is shown in the preferred embodiment to comprise an elongate tube 10 into which concrete can be poured and allowed to harden.

Referring to FIG. 1 there is shown an elongate concrete column 11 which is formed by hardening within tube 10. The tube 10 has been stripped away from the column 11. Column 11 is supported between a floor 12 and ceiling 14.

Figure 7:
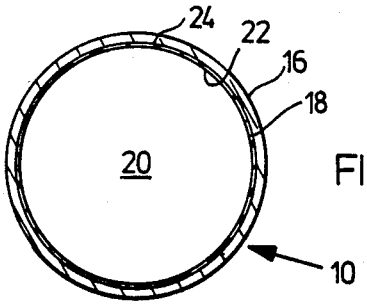
FIG. 7 is an end view of the disposable concrete forming apparatus of the present invention.
Figure 8:
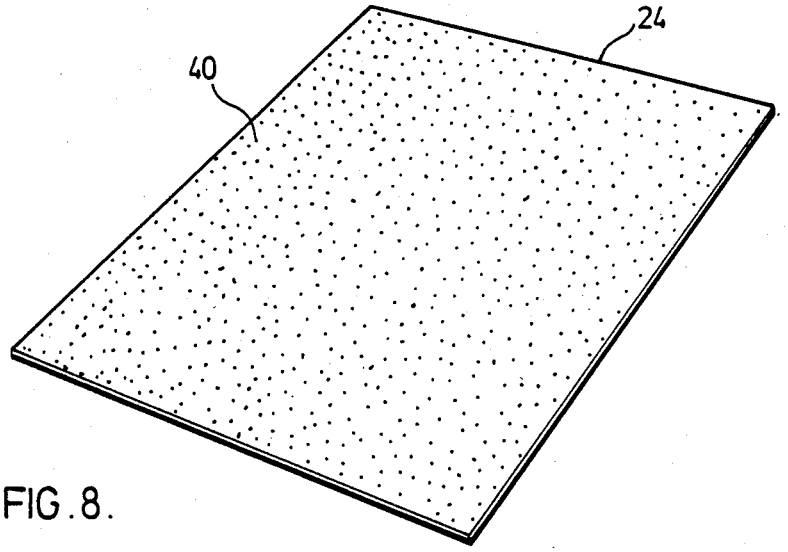
FIGS. 8 and 8*a* show different finishes or patterns for the liner means.
Figure 8A:
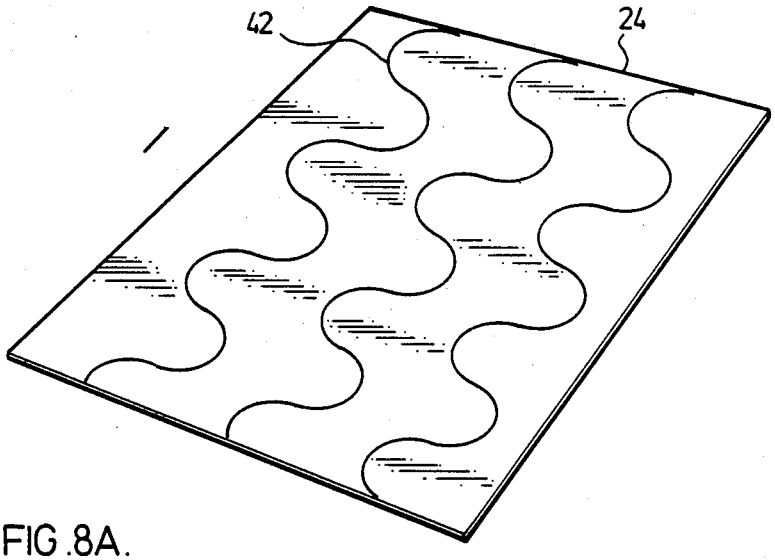

The tube 10 is basically illustrated in FIG. 7 to comprise a rigid forming means or paper tube 16 having an inner wall surface 18 which defines an enclosure 20. Inside the rigid tube 16 there is shown a flexible liner means or liner 22 which has an outside wall surface 24 normally biased to press against the inner wall surface 18 of the rigid tube 16 such that no gap is present along the entire length of the tube 10 between the inner wall 18 and the outer wall surface 22.

The outer rigid tube 16 comprises a strong fiber paper which is formed by spirally winding and laminating the paper together with a special adhesive along seams 26. The outside of the rigid tube 16 is covered with a hot wax for protection against adverse weather conditions. The rigid tube 16 used in the present invention is a PERMAFORM tube. PERMAFORM is a trade mark of Perma Tubes Ltd., of Mississauga, Ontario The liner 22 comprises a flexible impermeable material which prevents concrete hardening in the enclosure 20 from re-adsorbing moisture from the seams 26 (see FIG. 6) in the rigid tube 16. In order to provide a high gloss finish on the concrete 10, the liner 22 has an inside wall surface provided with a smooth or high gloss finish (FIG. 2). Suitable plastic materials may be used for the liner 22, such as, for example, a high impact polystyrene plastic. In the preferred construction of the present invention, the liner comprises Polystyrene 525 manufactured and supplied by G. M. Plastics of Granby, Quebec. This material has an excellent gloss, high heat resistance and toughness.

The thickness of the liner should be sufficient to prevent the spiral seams 26 from producing spiral form lines on the hardened concrete. In the preferred construction, the Polystyrene 525 liner should be thicker than twenty-two thousandths of an inch.

Figure 6:
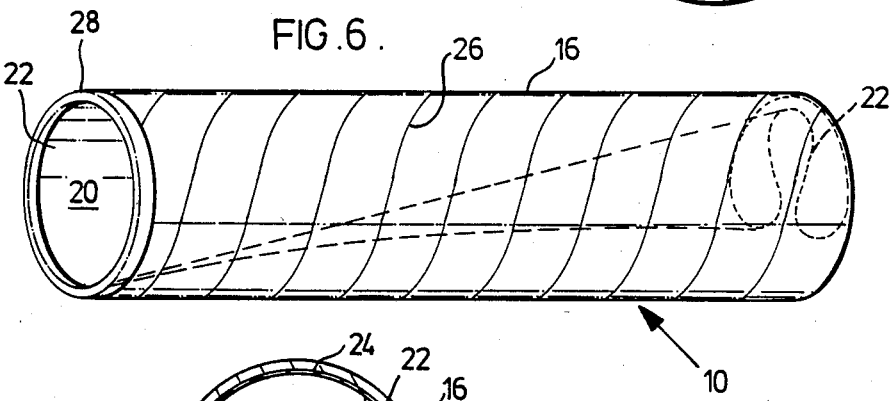

As shown in FIG. 6, the disposable concrete forming tube further includes means 28 for preventing at least one end of the liner 22 slipping relative to the rigid tube 16. This non-slipping means comprises tape 28. It should be understood that the other end of the tube 16 and liner 22 may be taped during shipping to prevent air from forcing the liner 22 away from the rigid tube during transportation of the tube 10. However, the tape at one end of the tube 10 should be cut to allow the liner 22 expand and shrink relative to the rigid tube 16 due to the effects of varying weather conditions. The other end of the tube should remain taped such that when this end will be placed at the uppermost position when the concrete is poured into the enclosure 20, the tape prevents the poured concrete from forcing its way between the liner 22 and the rigid tube 16.

The outside wall surface 24 of the liner 22 is dimensioned such that it presses against the inside wall surface 18 of the rigid tube 16. To accomplish this, the outside wall surface 24 has a circumference which corresponds to the circumference of the inside wall surface 18.

Figure 5:
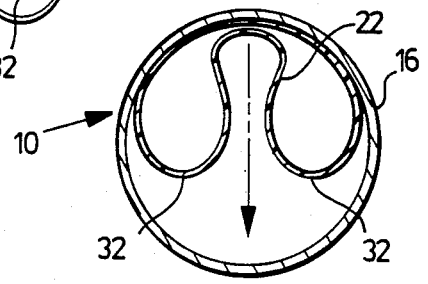
FIGS. 5 and 6 illustrate the insertion of the liner means into the rigid forming means of the disposable concrete forming apparatus of the present invention.

To construct the disposable concrete forming tube 10, the liner 22 is preferrably bent between a compressed position as shown in FIG. 5 and an expanded position as shown in FIG. 7.

To manufacture the concrete forming tube 10, the rigid tube 16 is manufactured in the known technique of spirally winding the paper fiber and using adhesives to join the paper fiber along seams 26. Once the paper fiber rigid tube 16 is formed, the liner 22 must be formed and inserted into the rigid tube 16.

The liner 22 is formed and inserted into the rigid tube 16 in steps substantially shown by the sequence of FIGS. 2 through 6 inclusive. Referring to FIG. 2, a sheet of the liner material 22 is positioned flat on three elongate wooden planks 30. The flexible sheet 22 is then folded as shown in FIG. 3 such that the outside lateral ends of the fold 32 lie within the outside planks 30 and the outside lateral edges 34 of the sheet are positioned immediately above the center plank 30. Thus, it can be said that the sheet is bent such that the lateral edges 34 of the sheet are adjacent each other with the folds 32 projecting outwardly therefrom. Tape 36 is then applied along the lateral edges 34 to interconnect the lateral edges 34. The liner 22 is then bent as shown in FIGS. 4 and 5 such that the folds 32 are positioned adjacent each other. At this point the liner 22 is in its compressed position (FIGS. 4 and 5). The liner 22 is then inserted while in its compressed position into rigid tube 16. One end of the liner is then released and the liner 22 expands along the longitudinal axis of rigid tube 16 (FIG. 6) from the released end to the unreleased end so that the liner moves into an expanded position with its outside wall surface 24 pressing against the inside wall surface 18 of the rigid tube 16 such that no gap is found therebetween. The ends of the rigid tube 16 and the liner 22 can then be taped to prevent any slippage between the rigid tube 16 and the liner 22 during transportation.

It should be understood that an elongate seam 38, provided between the lateral edges 34 of the liner 22 will be impressed onto the concrete structure 10. However, this will be a vertically extending line and will not be as readily apparent as the spiral form line heretofore described.

It should be understood that while the liner has a smooth or high gloss finsih in FIG. 2, the liner may have a roughened surface 40 or a surface with a predetermined pattern 42 which are formed on the hardened concrete.

What is claimed is:

1. A disposable concrete column forming apparatus for preventing the formation of undesirable form lines on the formed concrete column from forming as a result of the concrete forming apparatus and for preventing concrete column staining from water reabsorbtion back through the concrete column forming apparatus, comprising:

a rigid elongated forming tube having an inner wall surface defining an enclosure having a predetermined inside dimension and into which concrete can be poured and allowed to harden, said tube comprising spirally wound layers of paper sheet material defining undesirable spiral marking pattern and being circumferentially continuous with open opposite ends; and a flexible self-supporting tubular liner having an outside wall surface defining a predetermined outside dimension and open opposite ends that is slidably insertable into said rigid elongated forming tube and line said inner wall surface, said flexible self-supporting tubular liner including at least one sheet of a generally rectangular impermeable plastic material closed on itself and formed into a cylinder with its lateral edges abutting and secured together on the outside thereof with a tape that seals the abutting lateral edges, said impermeable plastic liner being cooperative with said tape to prevent water seepage therethrough and therewith prevent water reabsorbtion from staining the formed concrete column, said preselected outside dimension of said liner and said preselected inside dimension of said forming tube being so selected that the outside wall surface of the flexible self-supporting tubular liner is in a normally pressing engagement against the inner wall surface of the rigid forming means with no gap therebetween; the one sheet of plastic material having a predetermined thickness to preclude form lines forming on the hardened concrete that correspond to the spiral markings on the inner wall surface of said rigid forming means, said flexible liner being flexible between a compressed position permitting insertion of said flexible liner into the enclosure and a normally expanded position holding the flexible liner in pressing engagement against the inner wall surface of the enclosure without being bonded thereto.

2. The apparatus of claim 1 wherein the inner wall surface of said sheet of plastic material has a predetermined finish or pattern which is formed on the hardend concrete.

3. The apparatus of claim 2 wherein said finish is a high gloss finish.

4. The apparatus of claim 2 wherein said finish is a sand blasted finish.

5. The apparatus of claim 3 wherein said sheet of plastic material comprises a high impact polystyrene material and has a thickness not less than 22 one-thousanths of an inch.

6. The apparatus of claim 1 further including means for preventing one end of the flexible liner slipping relative to said rigid forming tube whereby the liner means is free to expand relative to the rigid forming means.

7. The apparatus of claim 6 wherein said means for preventing slippage comprises tape joining the one ends of said liner means and said rigid forming tube.

* * * * *